US006768088B2

(12) United States Patent
Kim

(10) Patent No.: US 6,768,088 B2
(45) Date of Patent: Jul. 27, 2004

(54) COOKING SHELF FOR MICROWAVE OVEN AND MICROWAVE OVEN HAVING THE SAME

(75) Inventor: Dae-Rae Kim, Hwasung (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/241,693

(22) Filed: Sep. 12, 2002

(65) Prior Publication Data

US 2003/0230572 A1 Dec. 18, 2003

(30) Foreign Application Priority Data

Jun. 14, 2002 (KR) ..... 10-2002-33085

(51) Int. Cl.[7] ..... H05B 6/78

(52) U.S. Cl. ..... 219/685; 219/754; 219/732; 219/763; 99/DIG. 14; 99/448; 126/337 A; 126/338

(58) Field of Search ..... 219/685, 754, 219/725, 732, 762, 763; 99/DIG. 14, 448, 421 R; 126/337 A, 337 R, 338

(56) References Cited

U.S. PATENT DOCUMENTS 4,027,583 A * 6/1977 Spanek et al. ..... 99/426
4,326,113 A * 4/1982 Toyoda et al. ..... 219/754
5,586,490 A * 12/1996 Saman ..... 99/421 R
6,172,347 B1 * 1/2001 Lee ..... 219/685

FOREIGN PATENT DOCUMENTS

JP 59-189232 * 10/1984 ..... 126/337 A

OTHER PUBLICATIONS

Patent Abstracts of Japan of Publication No. 59–189232, dated Oct. 26, 1984.

Patent Abstracts of Japan of Publication No. 60–164126, dated Aug. 27, 1985.

Patent Abstracts of Japan of Publication No. 11–159771, dated Jun. 15, 1999.

* cited by examiner

*Primary Examiner*—Philip H. Leung
(74) *Attorney, Agent, or Firm*—Staas & Halsey LLP

(57) ABSTRACT

A cooking shelf for a microwave oven allows food placed thereon to be equally close to its upper and lower heaters to evenly cook the food. The cooking shelf includes an upper shelf part having a certain area on which food is placed, a column part, which is downwardly extended from the upper shelf part by a certain length to support the upper shelf part, and a lower support part which is connected to a lower end of the column part and radially extended to support the column part.

17 Claims, 8 Drawing Sheets

COOKING SHELF FOR MICROWAVE OVEN AND MICROWAVE OVEN HAVING THE SAME

CROSS-REFERENCE TO RELATED APPLICATIONS

This application claims the benefit of Korean Application No. 2002-33085, filed Jun. 14, 2002, in the Korean Industrial Property Office, the disclosure of which is incorporated herein by reference.

BACKGROUND OF THE INVENTION

1. Field of the Invention

The present invention relates to a microwave oven, and more particularly, to a cooking shelf for a microwave oven and a microwave oven having the same, which is adapted to support food and to allow heat radiated from heaters of the microwave oven to be applied to the food.

2. Description of the Related Art

In general, a microwave oven is an electrical appliance to cook food disposed in its cooking chamber with high-frequency electromagnetic waves generated from a magnetron. In recent years, the microwave oven has been provided with a heater in the cooking chamber to carry out a cooking operation by heat from the heater, as well as high-frequency electromagnetic waves from a magnetron, thereby improving a cooking effect.

As shown in FIG. 1, a microwave oven includes a heater 2 positioned at an upper level of a cooking chamber 1, and a tray 3 placed on a bottom of the cooking chamber 1 on which food is placed. The cooking chamber 1 is externally provided at its bottom with a motor 4 to rotate the tray 3. When a cooking operation by the heater 2 is carried out, a cooking shelf 5 is placed on the bottom of the cooking chamber 1 to raise a level of food "F," so that heat from the heater 3 is effectively transmitted to the food "F."

However, since the heater 2 is positioned at the upper level of the cooking chamber 1, heat radiated from the heater 2 is largely applied to upper portions of the food "F". Hence, there is an inconvenience in that the food "F" placed on the cooking shelf 5 must be turned over during cooking in order to equally cook lower portions of the food "F."

To overcome the above inconvenience, microwave ovens have been developed to have heaters at its upper and lower levels, so that upper and lower portions of food "F" are equally heated by the upper and lower heaters. However, since the lower heater cannot be close to lower portions of the food "F" because of the configuration of the cooking shelf, a cooking effect of the lower portions of the food "F" is not satisfactory.

As shown in FIG. 2, a conventional cooking shelf 5 for a microwave oven includes a grill plate 5*a* on which food "F" is placed, and a plurality of support legs 5*b* downwardly extended from a peripheral edge of the grill plate 5*a*. Since the cooking shelf 5 is mounted on the tray 3 and rotated together with the tray 3, it is difficult to position the support legs 5*b* below the grill plate Sa, thereby limiting the cooking effect of the food "F".

SUMMARY OF THE INVENTION

Accordingly, it is an object of the present invention to provide a cooking shelf for a microwave oven and a microwave oven having the same, which is adapted to allow upper and lower heaters of the microwave oven to be equally close to food, so that the food is equally broiled at upper and lower portions of the food.

Additional objects and advantages of the invention will be set forth in part in the description which follows and, in part, will be obvious from the description, or may be learned by practice of the invention.

The foregoing and other objects of the present invention are achieved by providing a cooking shelf for a microwave oven, which is used in a cooking chamber of the microwave oven to cause food placed thereon to be close to a heater. The cooking shelf includes an upper shelf part having a certain area on which food is placed, a column part, which is downwardly extended from the upper shelf part by a certain length to support the upper shelf part, and a lower support part which is connected to a lower end of the column part and radially extended to support the column part.

According to an aspect of the invention, the upper shelf part includes an upper grill plate and a plurality of reinforcing arms, which are attached to a lower surface of the upper grill plate and radially extended from a center of the upper grill plate.

According to an aspect of the invention, the column part is downwardly bent at and downwardly extended from radial inner ends of the reinforcing arms.

According to an aspect of the invention, the lower support part includes a plurality of support legs, which are extended radially and outwardly from the lower end of the column part.

According to another aspect of the invention, the lower support part includes an annular retaining ring attached thereto to support the plurality of support legs.

According to another aspect of the invention, the lower support part includes a lower grill plate attached to the support legs, on which food is placed.

According to yet another aspect of the invention, the support legs are provided at their outer ends with extensions, which are extended downwardly by a certain length to cause the lower support part to be spaced from a bottom surface of the cooking chamber.

The foregoing and other objects of the present invention are achieved by providing a microwave oven including an oven body defining an exterior appearance of the microwave oven, a cooking chamber provided in the oven body, an upper heater disposed in the cooking chamber to be positioned at an upper level of the cooking chamber, and a lower heater disposed in the cooking chamber to be positioned at a lower level of the cooking chamber. The microwave oven also includes a cooking shelf disposed in the cooking chamber to cause food placed thereon to be positioned between the upper and lower heater. The cooking shelf includes an upper shelf part having a certain area on which food is placed, a column part, which is downwardly extended from the upper shelf part by a certain length to support the upper shelf part, and a lower support part which is connected to a lower end of the column part and radially extended to support the column part.

According to an aspect of the invention, the cooking chamber includes a rotatable tray at a bottom of the cooking chamber, on which the cooking shelf is mounted, and in which the column part is downwardly extended from a rotational axis of the upper shelf part so that the cooking shelf does not interfere with the lower heater when the cooking shelf is rotated.

BRIEF DESCRIPTION OF THE DRAWINGS

The above and other objects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
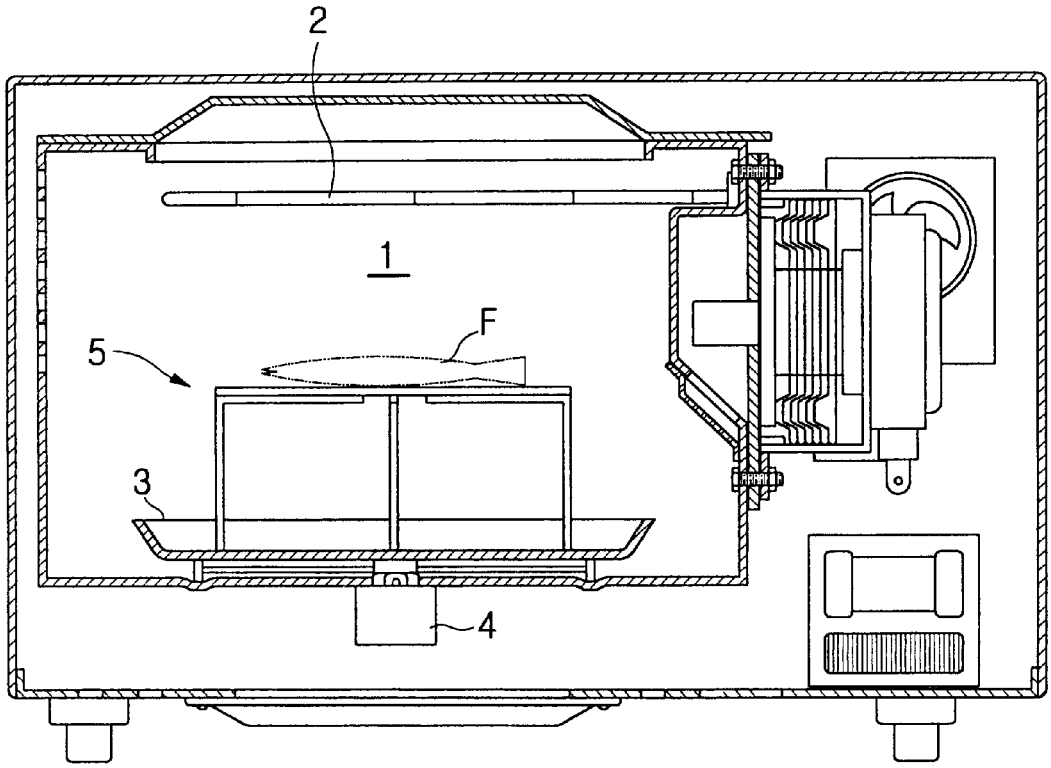
FIG. 1 PRIOR ART
FIG. 1 is a cross-sectional view showing a conventional microwave oven and a cooking shelf provided therein.
Figure 2:
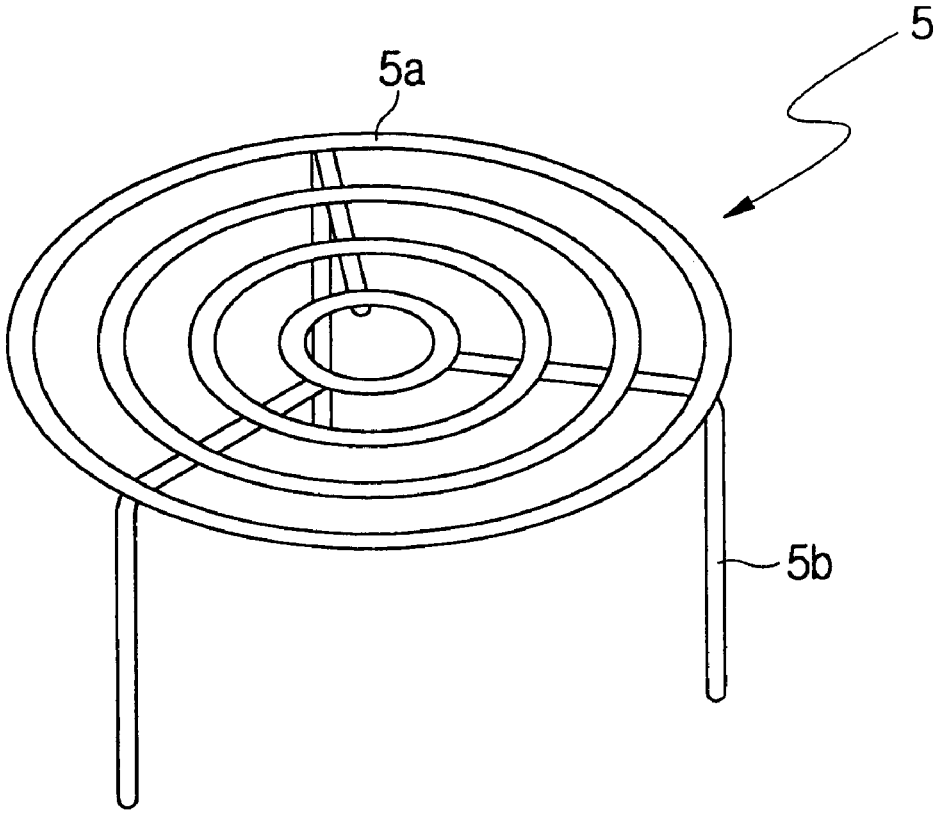
FIG. 2 PRIOR ART
FIG. 2 is a perspective view of a conventional cooking shelf for the microwave oven in FIG. 1.

Reference will now be made in detail to the present preferred embodiments of the present invention, examples of which are illustrated in the accompanying drawings, wherein like reference numerals refer to like elements throughout.

Figure 3:
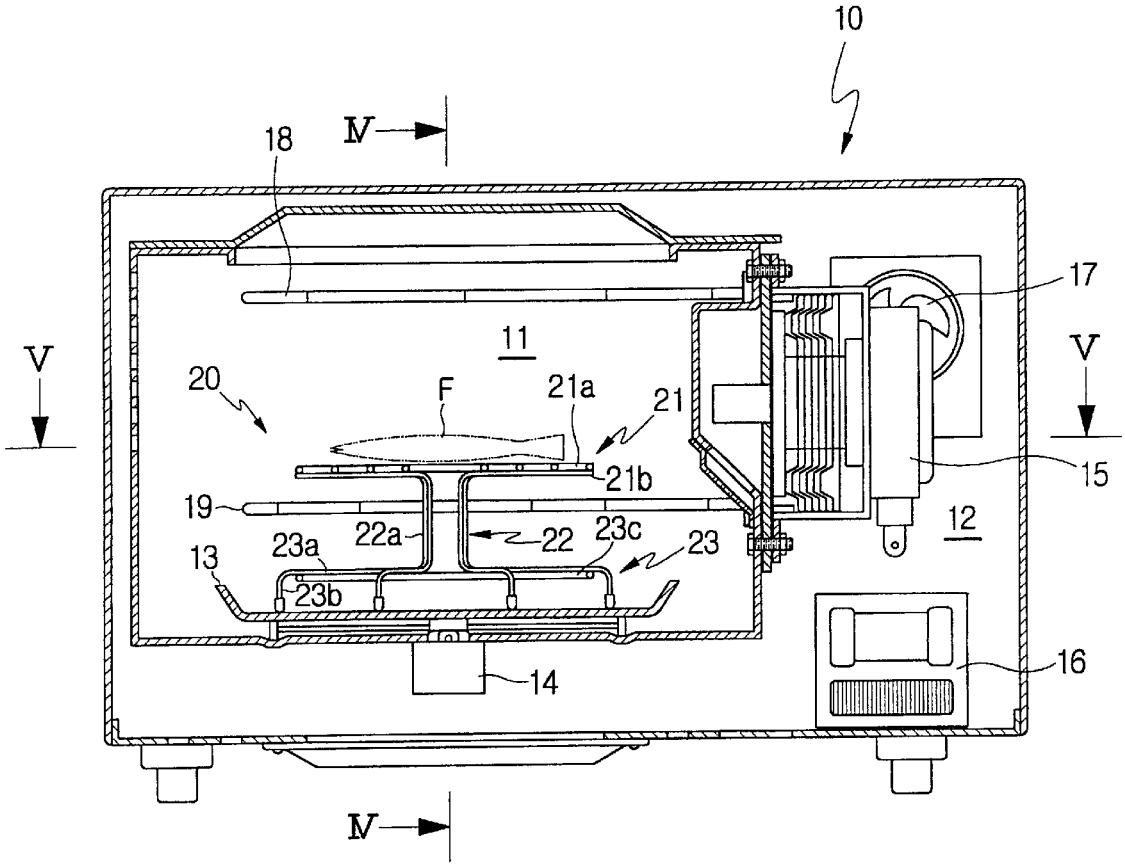
FIG. 3 is a cross-sectional view showing a microwave oven and a cooking shelf provided therein, according to an embodiment of the present invention.

As shown in FIG. 3, a microwave oven according to the present invention includes a cooking chamber 11 to receive food "F" to be cooked, and an electric component compartment 12 to receive various electric components, which are isolated from each other in an oven body 10. The cooking chamber 11 is rotatably provided at its bottom with a tray 13 on which the food "F" is placed. Furthermore, the cooking chamber 11 is externally provided at its bottom with a motor 14 to rotate the tray 13 at a low speed. The electric component compartment 12 is provided with a magnetron 15 to generate high-frequency electromagnetic waves into the cooking chamber 11, and a high voltage transformer 16 to apply high voltage to the magnetron 15. The electric component compartment 12 is further provided at its rear portion with a cooling fan 17 to cool the electric components in the electric component compartment 12.

Figure 4:
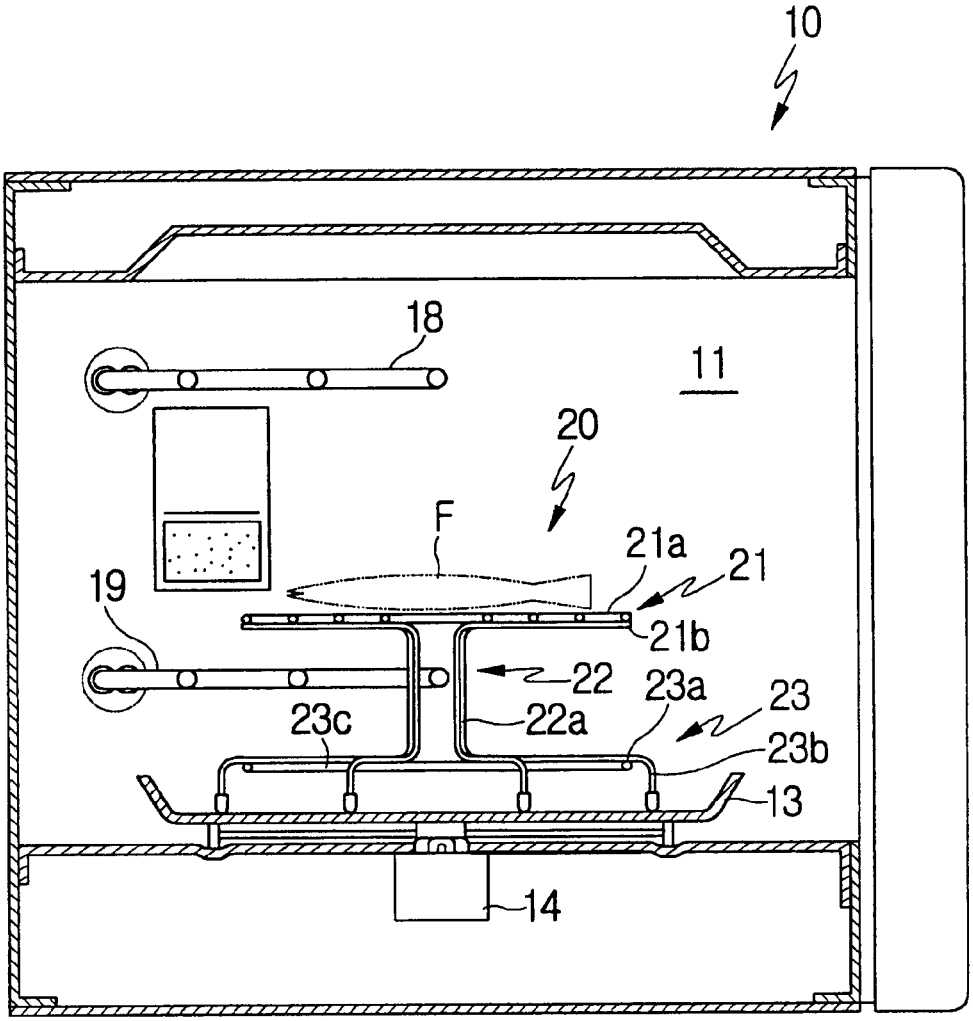
FIG. 4 is a cross-sectional view taken along line IV–IV' of FIG. 3.

As shown in FIGS. 3 and 4, to achieve cooking by heat as well as cooking by high-frequency electromagnetic waves generated from the magnetron 15, the cooking chamber 11 is provided at its rear and upper position with an upper heater 18 to radiate heat to the food "F" from a top portion of the cooking chamber 11, and is provided at its rear and lower position with a lower heater 19 to radiate heat to the food "F" from a bottom portion of the cooking chamber 11.

In addition to the upper and lower heaters 18 and 19, the cooking chamber 11 is provided therein with a cooking shelf 20, which is adapted to support the food "F" at a certain position between the upper and lower heaters 18 and 19 so as to equally heat upper and lower portions of the food "F".

As shown in FIGS. 3 through 6, the cooking shelf 20 includes an upper flat shelf part 21 having a certain area on which the food "F" to be cooked is placed, a central column part 22 which is downwardly extended from a center of the upper flat shelf part 21 by a certain length to support the upper flat shelf part 21, and a lower support leg part 23 which is radially extended from a lower end of the column part 22 to prevent the cooking shelf 20 from falling over.

Figure 6:
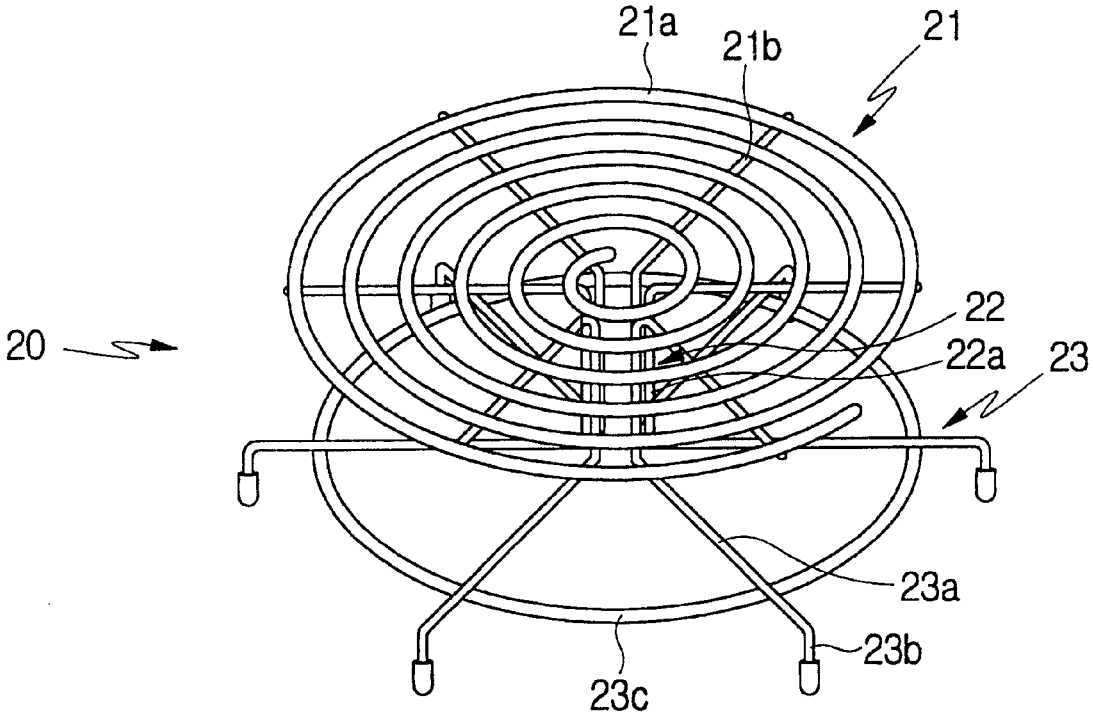
FIG. 6 is a perspective view of the cooking shelf for the microwave oven in FIG. 3.

As shown in FIG. 6, the upper shelf part 21 includes a grill plate 21*a* which is prepared by spirally bending an iron wire with a certain spacing to form a grill shape, and reinforcing arms 21*b* attached to a lower surface of the grill plate 21*a*. The reinforcing arms 21*b* include a plurality of iron wires radially extended from a center of the grill plate 21*a*, and are attached to a lower surface of the grill plate 21*a* by welding.

The column part 22 to support the upper shelf part 21 is integrally formed with the reinforcing arms 21*b* such that a plurality of vertical iron stems 22*a* are connected to inner ends of the plurality of iron wires constituting the reinforcing arms 21*b*, respectively. Here, it is preferable that the column part 22 is downwardly extended from a rotational axis of the upper shelf part 21 such that the column part 22 does not interfere with the lower heater 19 when the cooking shelf 20 mounted on the tray 13 is rotated.

The lower leg part 23 includes a plurality of support legs 23*a* radially extended from lower ends of the vertical stems 22*a* constituting the column part 22, and a retaining ring 23*c* attached to the plurality of radial support legs 23*a* to maintain postures of the support legs 23*a*. Each of the support legs 23*a* is provided at its outer end with a downward extension 23*b* such that the support legs 23*a* are maintained in a state of being spaced from an upper surface of the tray 13 by a certain distance. Here, it is preferable that the plurality of support legs 23*a* are integrally formed with the reinforcing arms 21*b* and the vertical stems 22*a* by bending their respective number of iron wires downwardly and outwardly in consideration of workability and manufacturing cost. Furthermore, it is preferable that a radial length of each of the support legs 23*a* is set to be longer than that of each of the upper shelf part 21 such that the cooking shelf 20 is prevented from falling over, even though heavy food may be placed on the upper shelf part 21.

Although the reinforcing arms 21*b* of the upper shelf part 21, the vertical stems 22 of the column part 22, and the support legs 23*a* of the lower leg part 23 are described to be integrally formed by the same number of iron wires, they may be manufactured in such a way that the column part 22 is manufactured by a rod or pipe having a certain length, and the upper shelf part 21 and the lower leg part 23 are coupled to upper and lower ends of the column part 22 by a welding process.

Figure 5:
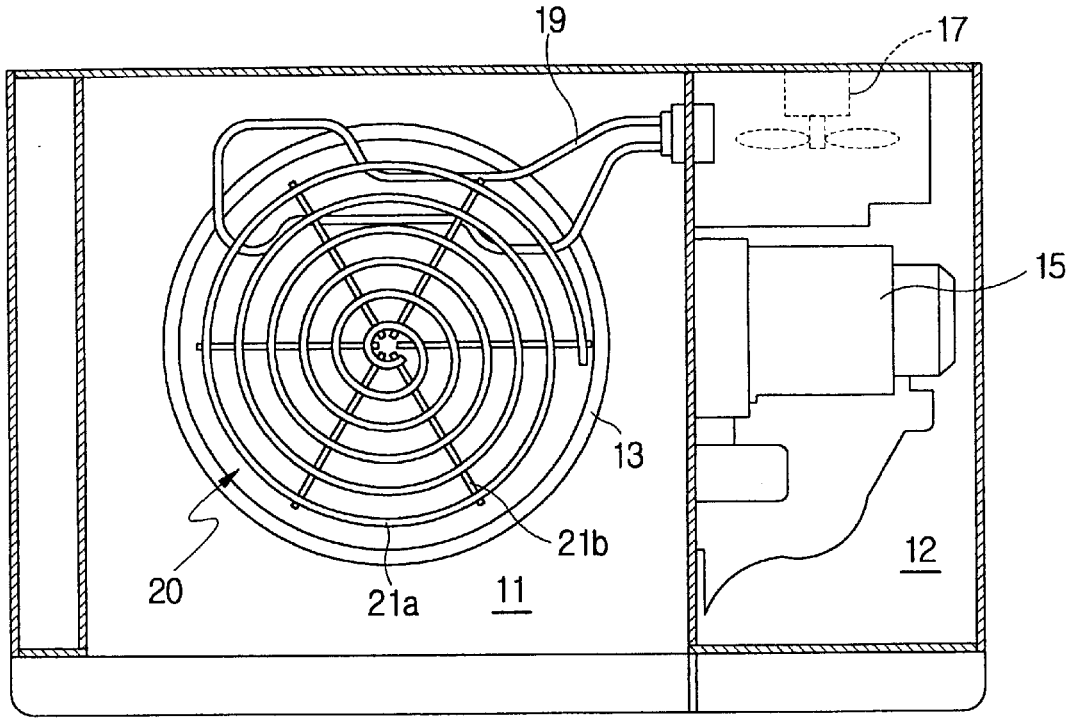
FIG. 5 is a cross-sectional view taken along line V–V' of FIG. 3.

When the cooking shelf 20 constructed in the above manner is installed in the cooking chamber 11, the lower leg part 23 of the cooking shelf 20 is placed on an upper surface of the rotatable tray 13, and the upper shelf part 21, which is connected to the lower leg part 23 via the column part 22, is positioned above the lower heater 19, as shown in FIGS. 3 through 5. Consequently, the food "F" placed on the upper shelf part 21 is equally heated at both its upper and lower portions by the upper and lower heaters 18 and 19, thereby allowing even cooking of the food "F."

In particular, since the cooking shelf 20 is constructed such that the upper shelf part 21 is supported by the column part 22 positioned at the rotational axis of the upper shelf part 21, the lower heater 19 is positioned just below the upper shelf part 21, as shown in FIGS. 4 and 5. Furthermore, since the cooking shelf 20 is freely rotated together with the tray 13 without interference with the lower heater 19 even though the lower heater 19 is positioned below the upper shelf part 21, the food "F" placed on the upper shelf part 21 is effectively and uniformly heated and cooked.

Figure 7:
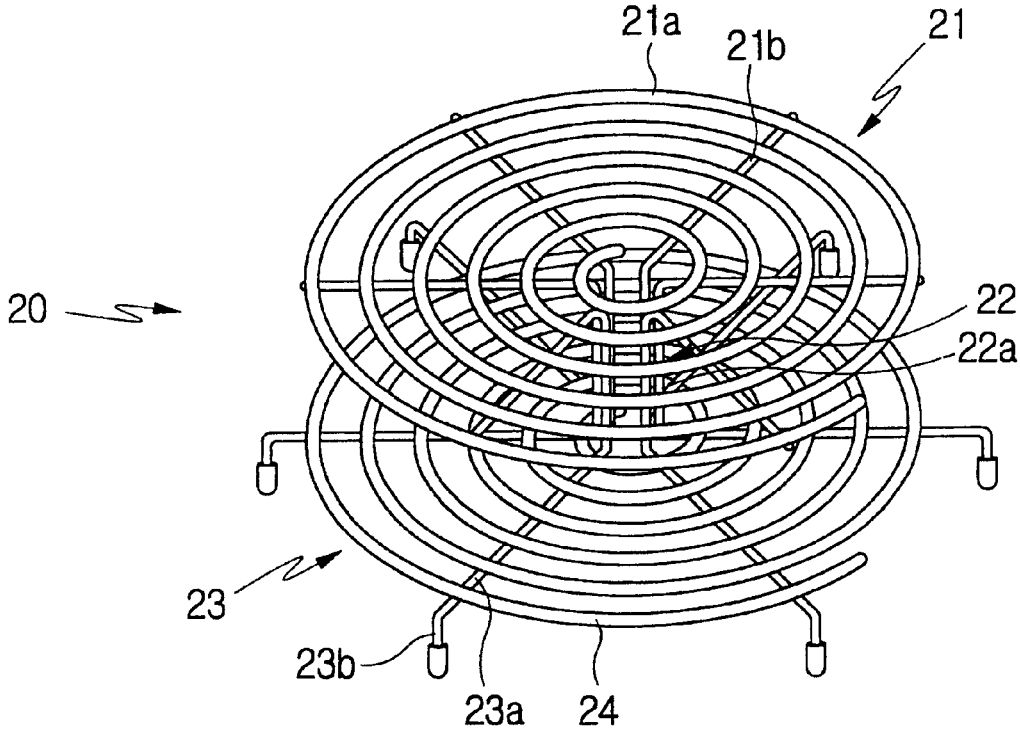
FIG. 7 is a perspective view of a cooking shelf for the microwave oven, according to another embodiment of the present invention.

FIG. 7 is a view of a cooking shelf for the microwave oven, according to another embodiment of the present invention. As shown in FIG. 7, the cooking shelf 20 is additionally provided on the support legs 23*a* with a lower grill plate 24 similar to the upper grill plate 21*a* of the upper shelf part 21, so that the cooking shelf 20 accommodates food on the lower leg part 23 as well as the upper shelf part 21.

Figure 8:
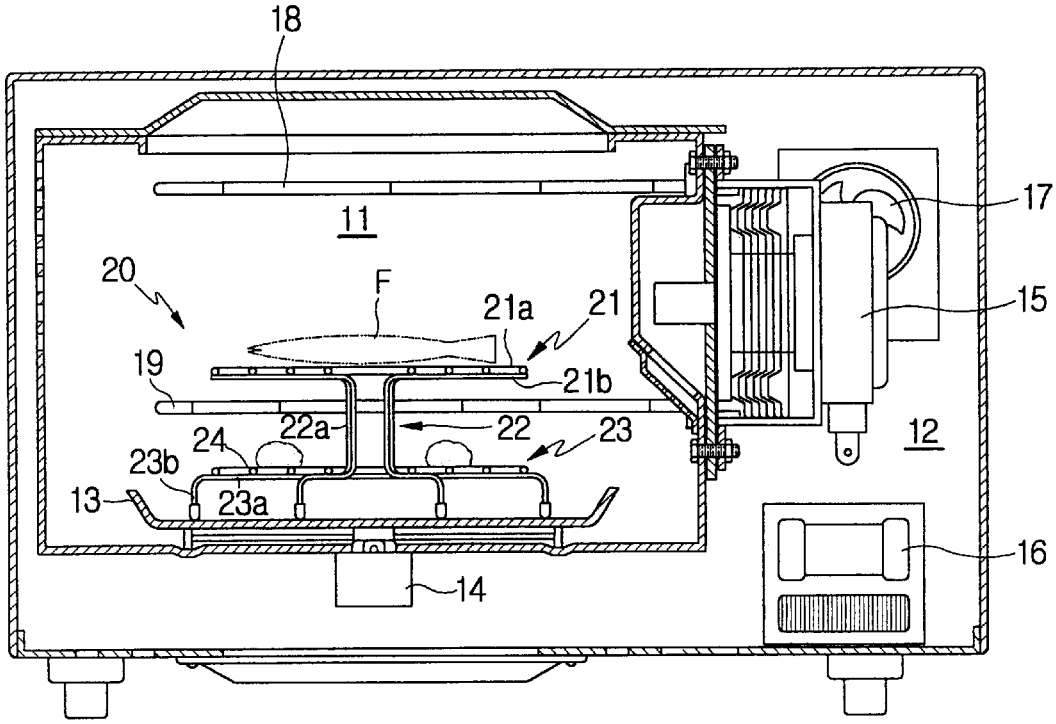
FIG. 8 is a cross-sectional view showing the microwave oven and the cooking shelf provided therein, according to the another embodiment described in FIG. 7.

Therefore, the cooking shelf 20 may also accommodate the food on the lower leg part 23, as well as the upper shelf part 21 to cook larger amounts of food, as shown in FIG. 8. Here, the food placed on the lower grill plate 24 is cooked by heat radiated from the lower heater 19.

As described above, since food placed on the cooking shelf according to the present invention is heated at its upper and lower portions concurrently by upper and lower heaters positioned above and below the food in close proximity thereto, the food is evenly cooked throughout.

In addition, since the cooking shelf is freely rotated without interference with a lower heater due to an upper shelf part being supported by a column part downwardly extended from a center of the upper shelf part, the cooking shelf according to the present invention enables food placed thereon to be more evenly cooked even though the lower heater is positioned below the upper shelf part.

Furthermore, since the cooking shelf according to the present invention accommodates food on a lower shelf part as well as the upper shelf part, it is possible to cook a larger amount of food at the same time.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus, comprising:

a cooking shelf to freely rotate in a microwave oven having an upper heater and lower heat and used in a cooking chamber of the microwave oven, to cause food placed thereon to be close to the upper and lower heaters, the cooking shelf including:

an upper shelf part having a certain area on which food is placed, the lower heater being disposed below the upper shelf Dart to heat the food placed on the upper shelf part; and a column part, which is downwardly extended from the upper shelf part by a certain length to support the upper shelf part, and to freely rotate without interference with the lower heater.

2. The apparatus as set forth in claim 1, further comprising:

a lower support part which is connected to a lower end of the column part and radially extended to support the column part.

3. The apparatus as set forth in claim 2, wherein the lower support part comprises:

a plurality of support legs which are extended radially and outwardly from the lower end of the column part.

4. The apparatus as set forth in claim 3, wherein the lower support part further comprises:

an annular retaining ring attached to the plurality of support legs to support the plurality of support legs.

5. The apparatus as set forth in claim 3, wherein the lower support part further comprises:

a lower grill plate attached to the support legs, on which the food is placed and cooked by heat radiated from the lower heater.

6. The apparatus as set forth in claim 3, wherein the support legs are provided at outer ends of the support legs with extensions, which are extended downwardly by a certain length to cause the lower support part to be spaced from a bottom surface of the cooking chamber.

7. The apparatus as set forth in claim 1, wherein the upper shelf part comprises:

an upper grill plate and a plurality of reinforcing arms, which are attached to a lower surface of the upper grill plate and radially extended from a center of the upper grill plate.

8. The apparatus as set forth in claim 7, wherein the column part is downwardly bent at and downwardly extended from radial inner ends of the reinforcing arms.

9. An apparatus, comprising:

a cooking shelf to freely rotate in a microwave oven having an upper heater and lower heater, and used in a cooking chamber of the microwave oven, to cause food placed thereon to be close to the upper and lower heaters, the cooking shelf including:

an upper shelf part having a certain area on which the food is placed, the lower heater being disposed below the upper shelf part to heat the food placed on the upper shelf part;

a column part, which is downwardly extended from the upper shelf part by a certain length to support the upper shelf part, and to freely rotate without interference with the lower heater; and a support unit having a certain area on which the food is placed, which is connected to an end of the column part opposite the upper shelf part and radially extended to support the column part.

10. A microwave oven, comprising:

an oven body defining an exterior appearance of the microwave oven;

a cooking chamber provided in the oven body;

an upper heater disposed in the cooking chamber to be positioned at an upper level of the cooking chamber;

a lower heater disposed in the cooking chamber to be positioned at a lower level of the cooking chamber; and a cooking shelf disposed in the cooking chamber, to freely rotate in the cooking chamber and to cause food placed on the cooking shelf to be positioned between the upper and lower heater, the cooking shelf comprising:

an upper shelf part having a certain area on which food is placed, the lower heater being disposed below the upper shelf part to heat the food placed on the upper shelf part;

a column part, which is downwardly extended from the upper shelf part by a certain length to support the upper shelf part, and to freely rotate without interference with the lower heater; and a lower support part, which is connected to a lower end of the column part and radially extended to support the column part.

11. The microwave oven as set forth in claim 10, wherein the cooking chamber comprises:

a rotatable tray at a bottom of the cooking chamber, on which the cooking shelf is mounted, and in which the column part is downwardly extended from a rotational axis of the upper shelf part so that the cooking shelf does not interfere with the lower heater when the cooking shelf is rotated.

12. The microwave oven as set forth in claim 11, wherein the upper shelf part comprises:

an upper grill plate and a plurality of reinforcing arms, which are attached to a lower surface of the upper grill plate and include a plurality of iron wires radially extended from a center of the upper grill plate.

13. The microwave oven as set forth in claim 12, wherein the column part is integrally formed with the reinforcing arms.

14. The microwave oven as set forth in claim 13, further comprising:

a plurality of support legs which are extended radially and outwardly from the lower end of the column part, and integrally formed with the reinforcing arms.

15. The microwave oven as set forth in claim 14, wherein the plurality of support legs extend outwardly from the upper shelf part to prevent the cooking shelf from tilting over.

16. The microwave oven as set forth in claim 11, wherein the cooking shelf is freely rotated together with the rotatable tray without interfering with the lower heater, thereby allowing food to be uniformly heated and cooked.

17. The microwave oven as set forth in claim 10, wherein the upper shelf part is positioned above the lower heater, thereby allowing food to be equally heated by the upper and lower heaters.

* * * * *

UNITED STATES PATENT AND TRADEMARK OFFICE

CERTIFICATE OF CORRECTION

PATENT NO. : 6,768,088 B2
DATED : July 27, 2004
INVENTOR(S) : Dae-Rae Kim

It is certified that error appears in the above-identified patent and that said Letters Patent is hereby corrected as shown below:

Column 5,
Line 44, "Dart" should be -- part --
Line 38, "heat" should be -- heater --

Signed and Sealed this

Fifteenth Day of February, 2005

JON W. DUDAS
*Director of the United States Patent and Trademark Office*